United States Patent [19]

Von Gunten

[11] 4,219,741

[45] Aug. 26, 1980

[54] RANDOM TIMER APPARATUS

[76] Inventor: Lee L. Von Gunten, 1515 E. Crabtree, Arlington Heights, Ill. 60004

[21] Appl. No.: 934,947

[22] Filed: Aug. 18, 1978

[51] Int. Cl.[2] ..... H01H 43/18; H01H 43/30

[52] U.S. Cl. ..... 307/141; 200/35 R; 200/38 R; 307/132 R

[58] Field of Search ..... 200/35 R, 38 R, 38 B, 200/153 L, 37 A, 38 D, 38 DA; 74/568 T; 307/132 R, 132 M, 141.4, 141

[56] References Cited

U.S. PATENT DOCUMENTS

| | | | |
|---|---|---|---|
| 3,155,848 | 11/1964 | Burford | 307/132 M X |
| 3,750,132 | 7/1973 | Natter | 200/38 D X |
| 3,925,629 | 12/1975 | Albinger | 200/38 R |
| 3,935,404 | 1/1976 | Persson | 200/35 R |
| 3,937,910 | 2/1976 | Fukami | 200/35 R |
| 4,123,915 | 11/1978 | Stoor | 200/38 B X |

*Primary Examiner*—Michael L. Gellner
*Assistant Examiner*—James L. Dwyer
*Attorney, Agent, or Firm*—Oldham, Oldham, Hudak & Weber Co.

[57] ABSTRACT

A random timer including a drive motor, an output means, and a power circuit connecting a power supply to the drive motor and output means and where two dissimilar timing elements are controlled by the drive motor, and the power circuit includes a multi-contact switch having a normally closed terminal position and a normally open second terminal position, a control member associated with the switch to move it from its normally closed position to its second position, and a control means individually engageable with the two different timing elements for moving the control member to its actuated second position and interrupt power flow to the output means on an irregular basis.

6 Claims, 9 Drawing Figures

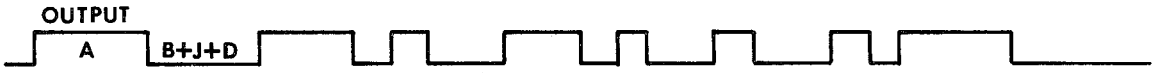
FIG. 2c
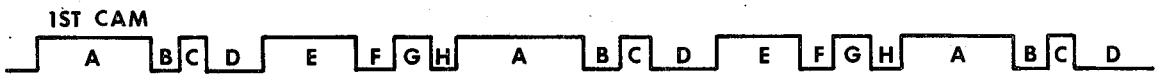
FIG. 2A
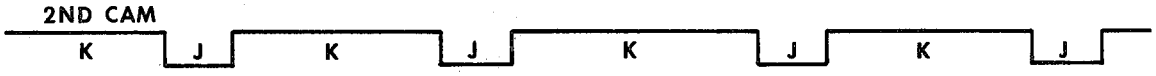
FIG. 2B
FIG. 2
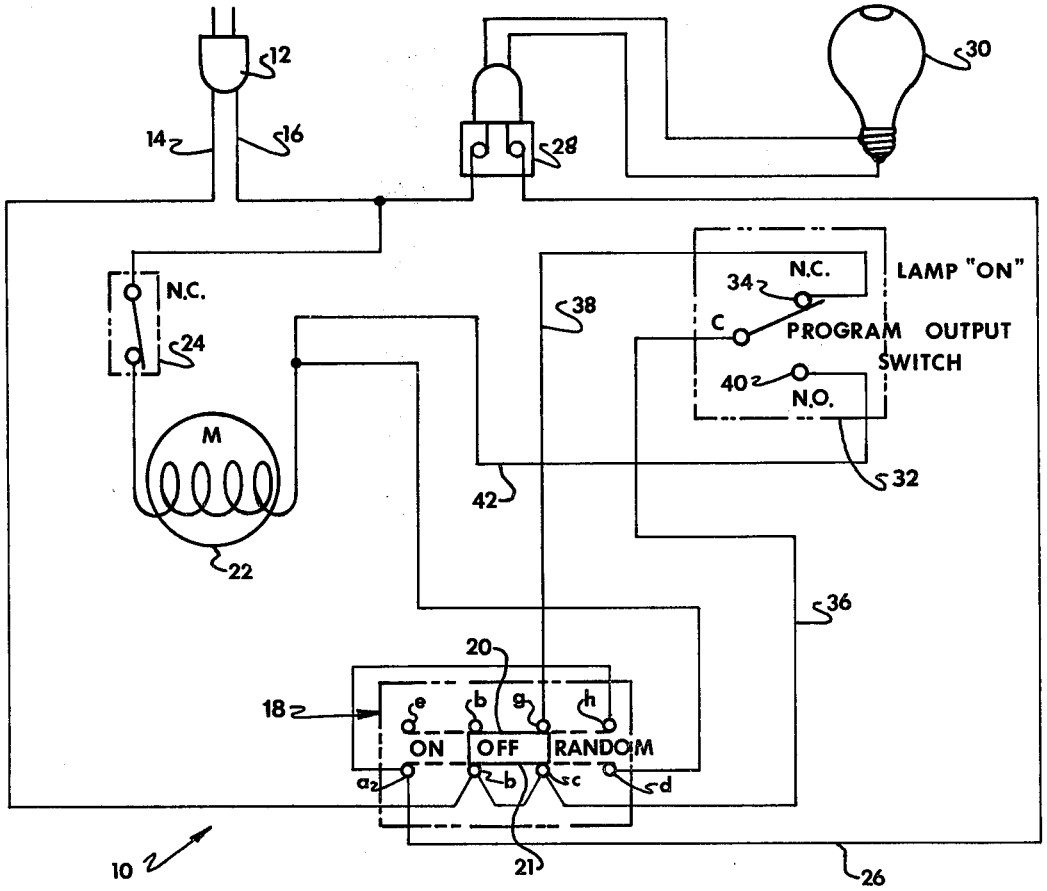
FIG. 1

RANDOM TIMER APPARATUS

BACKGROUND OF INVENTION

At the present time, various types of automatic timer devices are in wide use in many households as well as in industrial installations. These timer devices are used for a variety of purposes, but an extensive commercial usage has developed for timers in homes for turning night lights on and off and for, in general, indicating that the home is inhabited even though it is vacant at such time. These automatic timer devices are believed to be effective in deterring criminals from breaking into the homes, but most of the timers now available are subject to the fault or problem that they operate at exactly the same time on a 24 hour cycle basis so that if a person is observing the house, such cyclical nature of the actuation of the lights in the home might well be observed. Hence, a potential burglar might see that the house was unoccupied and that some automatic power supply unit was present to provide the illusion of home occupancy.

Various patents have been proposed heretofore on different types of timer constructions and some of them include U.S. Pat. Nos. 3,823,280; 3,997,742; 4,029,918 and 3,925,629 as being typical examples of prior timer constructions. Yet another timer switch assembly is shown in U.S. Pat. No. 3,935,404 wherein the assembly utilizes a motor coupled to a randomizing drive element which is periodically disconnected from the motor and switch at fixed time intervals and permitted to rotate to a random position. This controls the interval between switch closing and opening and to make the same random. Seemingly, no control exists in the person designing the timer to know exactly what types of timing cycles will be provided by a particular unit.

OBJECTS OF INVENTION

It is the general object of the present invention to provide a truly random timing device characterized by the presence of two timing elements having dissimilar cycles and operably interconnected to control the output cycle of the timer; and to provide the unit with a temperature control device in the drive motor circuit for interrupting and making truly random the power supply to the drive motor depending upon operating temperature conditions in the apparatus.

Another object of the invention is to provide a relatively simple mechanical unit that is made from uncomplicated, inexpensive but dependable primarily standard members whereby an effective timer device is provided and wherein a random power output is obtained from the unit.

Yet another object of the invention is to provide a random timer device utilizing a drive motor and two output cams having irregular or dissimilar timing characteristics and wherein the power output is interrupted when either one of the irregularly driven cam members is moved to an actuated position; and wherein the two dissimilar timing elements are connected in parallel in the power circuit, in effect, and where either timing element in an actuated position will prevent output from the timer unit; and to provide power to a drive motor under all operating conditions.

The foregoing and other objects and advantages of the invention will be made more apparent as the specification proceeds.

Attention now is particularly directed to the accompanying drawings, wherein:

FIG. 1 is a schematic electrical diagram of a circuit embodying the principles of the invention;

FIG. 2A is a diagrammatic illustration of a control cycle for one timing element;

FIG. 2B is a diagrammatic illustration of a control cycle of a second timing element; and FIG. 2C is a diagrammatic illustration of the supply of power by the combined timing elements actions to the outlet of the random timer for lamp illumination or other power control, as desired;

When referring to corresponding members shown in the drawings and referred to in the specification, corresponding numerals are used to facilitate comparison therebetween.

SUBJECT MATTER OF INVENTION

Figure 3:
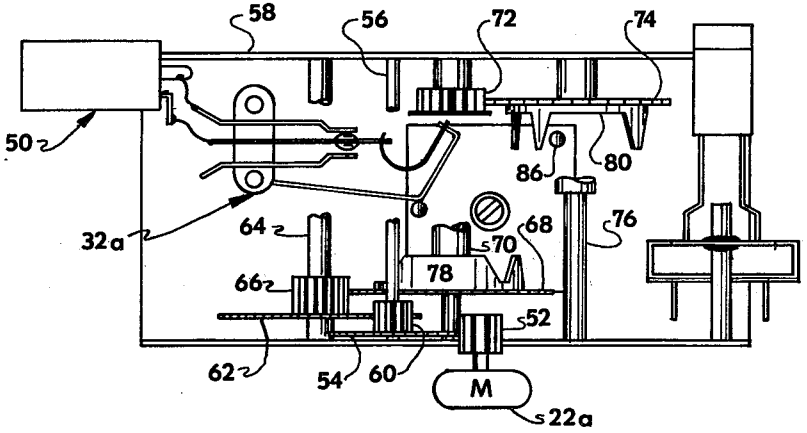
FIG. 3 is a fragmentary elevation of a portion of the random timer apparatus of the present invention.

The random timer device of the invention, as one embodiment thereof, comprises a drive motor, an output means, a control switch connectable to a power source; a power circuit connecting the control switch, drive motor and output means; two dissimilar timing elements powered by the drive motor, the power circuit including a multi-contact switch having a member therein movable from a normally closed first position supplying power to the output to a normally open second position for closing the terminal that is normally open, a control member operably connected to the switch to move it from its normally closed first position to its actuated second position when the control member is actuated, and connector and control means operably engageable individually with the two timing elements to move the control member to an actuated position for interrupting power flow to the output means on an irregular basis when either timing element is actuated, power being supplied to the drive motor by the switch from both of its positions.

RANDOM TIMING MEANS—OPERATING CYCLES

FIGS. 2A and 2B of the drawings indicate diagrammatically how a first camming or timing means has a repetitive cycle indicated timewise by the block lines of the drawing, and where the cycles for actuation or power supply would be those with the upstanding cycle indication by the blocks or lines A, C, E and G, and with such cam being in its "off" or "non-power" supply position during the camming intervals indicated by the lines or sections B, D, F and H. This cycle A through H would then be repetitive for operation of the apparatus. However, the second timing device or cam means in the unit can have quite a different cycle as indicated by a very long cam operative position or timing interval K and a relatively short timing interval for the "off" power supply position J. This is a relatively short cam time action in relation to the length of cycle of the first cam means and thus the short cycle of the second cam would repeat itself an odd number such as one and fifteen/sixteenths times for each full operational cycle of the first cam. Then, when the two cams are combined to provide actuation of the output means only when both of these cam means are in their power or "on" cycle, the resultant power cycle supply is of the quite irregular design as indicated by the upstanding time sections in FIG. 2C. Since the two cams or timers run at different speeds, a random relationship is set up for supplying power to the output of the unit and power is supplied thereto only when both of the cam means are in the power "on" portion of their supply cycle.

DIAGRAMMATIC CIRCUIT DESCRIPTION

FIG. 1 has shown therein a suitable diagrammatic circuit for the random timer device of the invention and wherein this circuit is indicated as a whole by the numeral 10. It includes a conventional power supply plug 12 for engaging a power outlet to supply power to leads 14 and 16. Lead 14 connects to a multi-contact switch 18 that has on, off and "random" switch positions, as indicated. This switch has contacts a, b, c through h provided therein and a pair of slide bars 20 and 21 are present in the switch for moving or being controlled so as to connect power supply to the operative circuit 10, or to shut it off, as desired.

Specifically, the power lead 14 connects to the contacts b and c whereby when this switch is moved to its "random" position, power is continuously transmitted to a motor 22 that is the drive motor of the unit and which motor circuit in turn connects back to the lead 16. The motor drives two dissimilar timing elements used in the random timer apparatus of the invention, all as described hereinafter in more detail. The motor circuit also preferably includes therein a conventional thermostat 24 that is normally closed and which is positioned physically adjacent the motor 22 so that the thermostat will open the power supply circuit for the motor for an indefinite interval when it reaches any excessive temperatures, all as set up in accordance with predetermined desired operating conditions for the timer. The thermostat 24 can be of any conventional construction and is calibrated to function for intermittent shut-off of the motor when it has been operating for some time and its temperature has increased to a temperature above the ambient temperature. Such thermostat is fully random in its time of actuation.

When the switch 18 is in its "on" position, power just flows directly through a line 26 to an output receptacle 28 that connects to an output indicator, such as a lamp 30. However, when the system is on its "random" setup, power then reaches this output receptacle 28 through a multi-contact switch or other similar control device 32. In this particular embodiment of the invention, the multi-contact switch is shown as having normally closed first position or terminal 34 that is powered from the switch 18 by a lead 36 and with the terminal 34 in turn contacting through a lead 38 back to the switch 18 and from it back to the lead 26 for power supply to the outlet 28. However, when the operating conditions are such as described hereinafter, and the switch 32 is moved to its second position closing a terminal or contact 40, that is normally open in the switch, then power is maintained to the motor 22 by a lead 42 but the circuit to the outlet receptacle 28 is interrupted whereby the motor will operate and continue to drive the timing elements for other operating conditions and to maintain the desired random energization of the output receptacle 28. Such motor operation also occurs when the switch 18 is in its "off" position, as long as the terminal 40 is closed.

Naturally, in the "on" position of the switch 18, the output receptacle 28 has power supplied thereto at all times.

RANDOM TIMER APPARATUS

Other figures of the drawings, including FIGS. 3 through 7, show details of the mechanical embodiment of the apparatus diagrammatically shown in FIG. 1. Corresponding members from FIG. 1 are referred to with corresponding numbers in FIG. 3, but with the suffix a being added so that comparison can be made between these corresponding elements, but the multi-contact switch in these figures is indicated as a whole by the numeral 50 to distinguish from the use of the terminal numeral 18*a* previously referred to herein. The motor 22*a* is indicated and it is controlled in its operation by a multi-contact switch 32*a* in the apparatus.

More specifically, the motor 22*a* has an output shaft driving output gear 52 and this gear connects to a suitable gear train means to control and regulate drive for two dissimilar timer means provided in the apparatus. In this gear train means the relatively small diameter gear 52 engages and drives a relatively large diameter gear 54 mounted on a shaft 56 that is suitably journalled on or between opposed portions of a frame 58 forming a portion of the mounting means in the device of the invention. A small diameter output gear 60 on the shaft 56 in turn engages and drives a large diameter gear 62 carried on a further operating shaft 64 journalled on the apparatus frame and reduced speed drive then is taken from a small diameter output gear 66 on the shaft 64 to a driven large diameter gear 68 in turn mounted on yet a third operating and output shaft 70 journalled on the frame of the apparatus. This relatively slowly driven output shaft 70 in turn has a drive gear 72 on it and such small diameter gear engages and drives a second output gear 74 operatively positioned and carried by a second driven output shaft 76 operatively mounted on the frame 58.

Important features of the present invention are that the drive impulses or controls are taken from the two dissimilar timing elements by use of the output shafts 70 and 76, and that the control cams function in a manner described hereinafter in more detail.

So as to provide random output from this unit 10 controlled by the motor 22*a*, a pair of annular output cams 78 and 80 are individually operably mounted on side faces of the gears 68 and 74, respectively, and these two cams are of completely different protruding operative contours to provide a random arrangement between cammed or operatively positions for these rotary cams as they are driven by different shafts through the gear train means. At the present time, I prefer to make these cams from plastic and they are conventionally secured to the mounting gears for engaging, individually, a control member or device indicated as a whole by the numeral 82. Such control device 82 preferably comprises a metal plate or similar member 84 that is journalled on a portion of the frame 58 for limited pivotal movement by control means operatively connecting between such plate 84 and the cams 78 and 80.

Figure 6:
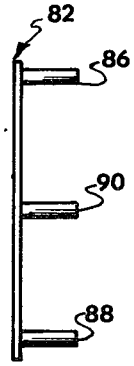
FIG. 6 is a side elevation of the timer control plate of FIG. 5.
Figure 5:
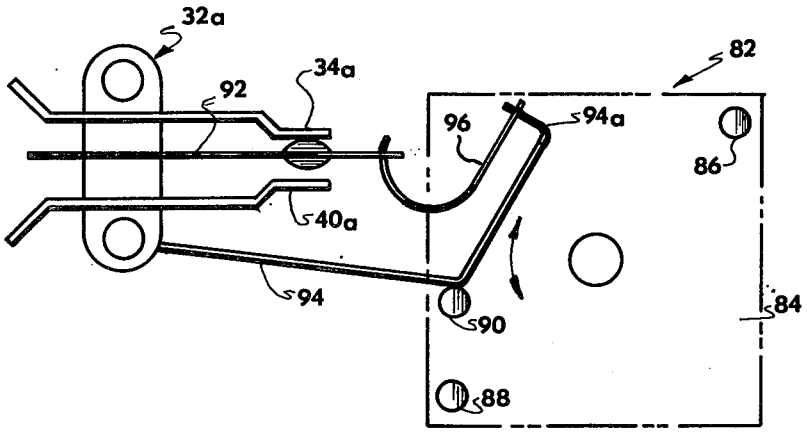
FIG. 5 is a fragmentary enlarged elevation of the multi-contact switch and associated control means of the timer device.
Figure 4:
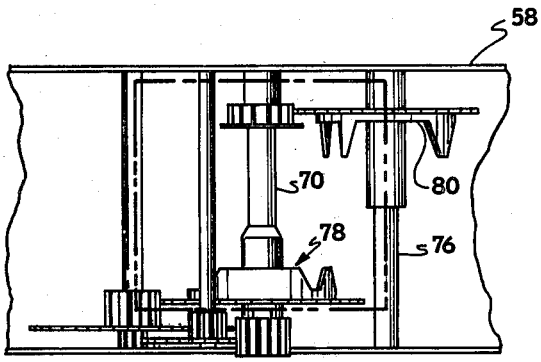
FIG. 4 is a somewhat diagrammatic view of the gear train means and power supply means used in the timer device of the invention.
Figure 7:
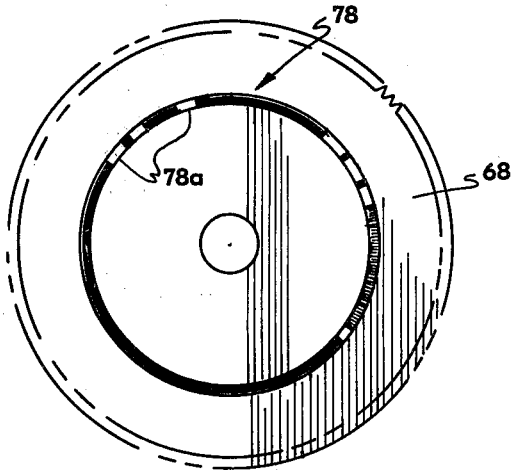
FIG. 7 is a plan of a cam member.

These cams 78 and 80 are positioned in opposed spaced relation by the frame 58, and the plate 84 has an operating finger 86 provided adjacent its upper righthand corner and an operating finger or pin 88 adjacent its lower lefthand corner while yet a further control pin or device 90 is provided on the plate. All of these pins or rods 86, 88 and 90 extend operably from the plane defined by the plate, as indicated in FIG. 6. This control device 82 is used for physically regulating and actuating the multi-contact switch 32*a* that in turn has one normally closed terminal 34*a* and one normally open terminal 40*a* with a movable spring arm 92 being positioned intermediate the terminals 34*a* and 40*a* and adapted to be moved from contacting one terminal to a position contacting the other terminal. Connecting members forming a part of the device 82 in this embodiment of the invention comprise a spring arm 94 mounted on the switch 32*a* and extending out to laterally overlap the control plate 84. The spring arm 94 normally rests against an actuating pin or finger 90 on plate 84 whereby when such plate is moved upwardly to an operated or actuating position, an upper end portion 94*a* of the spring arm engages, continually, a connecting arcuate spring member 96 which in turn connects to the free end of the spring arm 92 and normally raises the same to its normally closed position. However, when such spring arm 94 is actuated by being lifted vertically by plate 84 and pin 90, the connection between the spring arms 92, 94 and 96 is such that it causes the spring arm 92 to bend downwardly and contact and close the normally open terminal 40*a* Such a condition will be maintained only as long as the control plate 84 has been moved through a slight arc in a clockwise direction by the pin 88, for example, being engaged by an operative section 78*a* of the control cam 78 to elevate the plate. A similar action is also obtained when one of the operative cam fingers or sections on the cam device 80 contacts the control pin 86 and forces such control plate to move through a short arc in a clockwise direction, but moving it downwardly by this cam means 80. Thus, at irregular intervals, the cams 78 and 80 by their protruding operative finger sections 78*a*, 80*a*, etc. will actuate the multi-contact switch 32*a* and cause a change in position of the normally closed terminal 34*a*. At the same time, the power supply to the motor 22*a* will be maintained by a lead 42 from the terminal 40 which connects to the motor power supply line when the switch 18 is in its "off" position to drive the gear train to a power output "on" condition before drive to the motor is terminated.

The motor 22*a* is shown diagrammatically in FIG. 3 and it can be of any suitable type or size and be mounted on the frame 58 in a known manner.

Power can be supplied to the random timer unit of the invention by a fixedly controlled timer or by a manual control as desired.

Output of the timer is substantially random by use of the timer cams 78 and 80. Naturally any known drive or connector means may couple the cams 78 and 80 to the output switch 32*a* to regulate output therefrom.

The switch 18 is mechanically conventional and it moves the bars 20 and 21 as a unit to the power control positions of "on", "random", or "off", as described.

The unit of the invention is reliable and is not costly but yet has a completely irregular cycle.

The apparatus disclosed will not normally have a repetitive cycle, and it is believed to achieve the objects of the invention.

While one complete embodiment of the invention has been disclosed herein, it will be appreciated that modification of this particular embodiment of the invention may be resorted to without departing from the scope of the invention.

What is claimed is:

1. A timer device comprising a drive motor, an output means, a control switch connectable to a power source, and a power circuit connecting said control switch, drive motor, and said output means, and characterized by two dissimilar timing elements, said power circuit including a multi-contact switch having a member movable from a normally closed terminal first position to a normally open terminal second position to close the same, power being supplied to said output means by said switch first position, a control member operably connected to said multi-contact switch to move same from its normally closed position to its actuated second position closing its normally open terminal, connector and control means engageable individually with said timing elements to move said control member to its actuated second position to interrupt power flow to said output means on an irregular basis, and said power circuit being connected so as to maintain power supply to said drive motor at elected times, and a normally closed thermostat is connected in series with said drive motor and is operably associated with said drive motor to open its power circuit at predetermined temperatures.

2. An unpredictable timer device comprising a drive motor, an output means, a control switch connectable to a power source, a power circuit connecting said control switch, drive motor, and said output means, gear train means coupled to and driven by said drive motor and including a pair of control shafts driven at different speeds, said power circuit including a multi-contact switch having a flexible spring arm movable from a normally closed first position to a normally open terminal second position to close the same, the normally closed terminal connecting to said output means, a pivotally positioned control member operably resiliently connected to said multi-contact switch to move same from its normally closed to an actuated position closing its normally open terminal, a cam device operably carried on each of said control shaft for individually engaging said control member to move it to its actuated position to interrupt power flow to said output means on an irregular basis, and a control thermostat is provided in said drive motor circuit to interrupt the same on predeterminerd temperature rises therein to provide an unpredictable variable factor in the power supply to said output means, said control thermostat being operated by ambient temperature conditions.

3. A timer as in claim 2 where said power circuit has said drive motor connected to both said first position and said second position of said switch to maintain power supply to said drive motor.

4. A timer as in claim 2 where said cam devices are annular means having irregular cam flanges protruding therefrom, each of said cam devices being mounted on a side face of a different gear of said gear train means.

5. A timer as in claim 4 where said control member comprises a plate, means pivotally positioning said plate on the frame of the timer for oscillatory arcuate movement, two protruding pin means on said plate for individually engaging one of said cam devices to move said plate to an operative position, and a spring member operably mounted on said frame connecting said plate to said switch spring arm to change its position to its said second position when said plate is in an operative position.

6. A timer device comprising a drive motor, an output means, a power control switch connectable to a power source, and a power circuit connecting said control switch, drive motor, and said output means, and characterized by two dissimilar timing elements driven at different speeds by said drive motor;

said power circuit including a switch means having a member movable from a normally closed terminal first position to an open circuit position, said output means being energized by said switch means and its said first position, a control member operably connected to said switch means to move same from its normally closed position to its actuated open circuit position, connector and control means engageable individually and operably with said timing elements to move said control member to an actuated position to move said control member to open said switch means and interrupt power flow to said output means on an irregular basis, and an ambient temperature controlled switch member in said power circuit controlling power supply to said motor to be opened at irregular intervals dependent upon the existence of high ambient temperatures.

* * * * *